US007125142B2

(12) United States Patent
Wainwright

(10) Patent No.: US 7,125,142 B2
(45) Date of Patent: Oct. 24, 2006

(54) FLAME SIMULATING DEVICE

(75) Inventor: Harry Lee Wainwright, 950 Pembroke Rd., Bethlehem, PA (US) 18017-7026

(73) Assignee: Harry Lee Wainwright, Bethleham, PA (US)

( * ) Notice: Subject to any disclaimer, the term of this patent is extended or adjusted under 35 U.S.C. 154(b) by 44 days.

(21) Appl. No.: 10/838,785

(22) Filed: May 4, 2004

(65) Prior Publication Data

US 2004/0223326 A1 Nov. 11, 2004

Related U.S. Application Data

(60) Provisional application No. 60/468,185, filed on May 6, 2003.

(51) Int. Cl.
*F21V 9/00* (2006.01)

(52) U.S. Cl. ..... 362/231; 362/251; 362/276; 362/392; 362/810

(58) Field of Classification Search ..... 362/231, 362/251, 806, 276, 392, 810
See application file for complete search history.

(56) References Cited

U.S. PATENT DOCUMENTS 4,550,363 A 10/1985 Sandell
D418,928 S 1/2000 Zhang et al.
D422,100 S 3/2000 Zhang et al.
6,454,425 B1 9/2002 Lin
2001/0033488 A1* 10/2001 Chliwnyj et al. ..... 362/231
2003/0102810 A1 6/2003 Cross et al.
2003/0161145 A1* 8/2003 Liu et al. ..... 362/161

OTHER PUBLICATIONS

"Mule Lighting", www.mulelighting.com, printed Apr. 26, 2004.

* cited by examiner

*Primary Examiner*—Stephen F. Husar
*Assistant Examiner*—Meghan K. Dunwiddie
(74) *Attorney, Agent, or Firm*—Bereskin & Parr; Isis E. Caulder

(57) ABSTRACT

A flame simulating device includes a substantially translucent shell having a hollow interior, a plurality of colored light sources, positioned within the hollow interior of said shell and a light source driving device for selectively activating each of said plurality of light sources. Each of the light sources are alternately and individually activated to have active periods and such that the surface of said shell is illuminated to produce an animated flame effect. In one example implementation, yellow, orange and red LEDs are positioned at varying heights within the flame-shaped shell and activated on and off in a sequence that follows a set of color transition rules in order to provide a close simulation of the flickering of a flame. During their active periods, LEDs are blinked on and off to conserve power.

12 Claims, 6 Drawing Sheets

FLAME SIMULATING DEVICE

This application claims the benefit under 35 U.S.C. 119(*e*) of U.S. Provisional Application No. 60/468,185, filed May 6, 2003.

FIELD OF THE INVENTION

This invention relates to display devices and particularly to flame simulating devices.

BACKGROUND OF THE INVENTION

Conventional flame sources require lighting with matches or the like, and when lit, represent a serious fire hazard, especially when unattended as is the case in commercial settings (e.g. restaurants, stores etc.) Furthermore, real flame sources (e.g. candles) present other personal injury and collateral damage challenges (e.g. dripping wax on people and/or upholstery etc.) Finally, real flame sources are easily extinguished (e.g. by air currents etc.) and accordingly cannot be easily setup and maintained without constant monitoring.

There are a variety of flame imitation novelty products that utilize various methods to simulate a real flame for display purposes such as those disclosed in U.S. Pat. Nos. 6,454,425 and 4,550,363. Specifically, U.S. Pat. No. 6,454,425 discloses a candle flame simulating device that includes a blowing device for generating an air and for directing the air toward a flame-like flexible member, in order to blow and to oscillate or to vibrate the flame-like flexible member and to simulate a candle. U.S. Pat. No. 4,550,363 discloses an electric-light bulb fitted with a light permeable and light-scatting lamp casing. However, such attempts result in flame displays that are relatively poor imitations of a real flame. In addition, such devices require substantial energy and require frequent battery replacement.

SUMMARY OF THE INVENTION

The invention provides in one aspect, a flame simulating device comprising:

(a) a substantially translucent shell having a hollow interior and a directional axis;

(b) a plurality of colored light sources, adapted to be positioned within the hollow interior of said shell, wherein said light sources include a first light source emitting light having a first frequency, a second light source emitting light having a second frequency and a third light source emitting light having a third frequency and wherein said third frequency is greater than said second frequency and said second frequency is greater than said first frequency;

(c) a light source driving device for selectively activating said first, second and third light sources according to the following transition rules:

i. if the first light source is active then activate the second light source next;

ii. if the second light source is active then activate either the first light source or the third light source next; and iii. if the third light source is active then activate the second light source next;

(d) each of said first, second and third light sources being sequentially activated such that the surface of said shell is illuminated and produces an animated flame effect.

In another aspect, the invention provides a flame simulating device comprising:

(a) a substantially translucent shell having a hollow interior and a directional axis;

(b) a plurality of colored light sources, adapted to be positioned within the hollow interior of said shell, said plurality of light sources being positioned in a spaced apart manner at different heights as measured along the directional axis of said shell;

(c) a light source driving device for selectively activating each of said plurality of light sources;

(d) each of said light sources being sequentially activated such that the surface of said shell is illuminated and produces an animated flame effect.

Further aspects and advantages of the invention will appear from the following description taken together with the accompanying drawings.

DETAILED DESCRIPTION OF THE INVENTION

Figure 1:
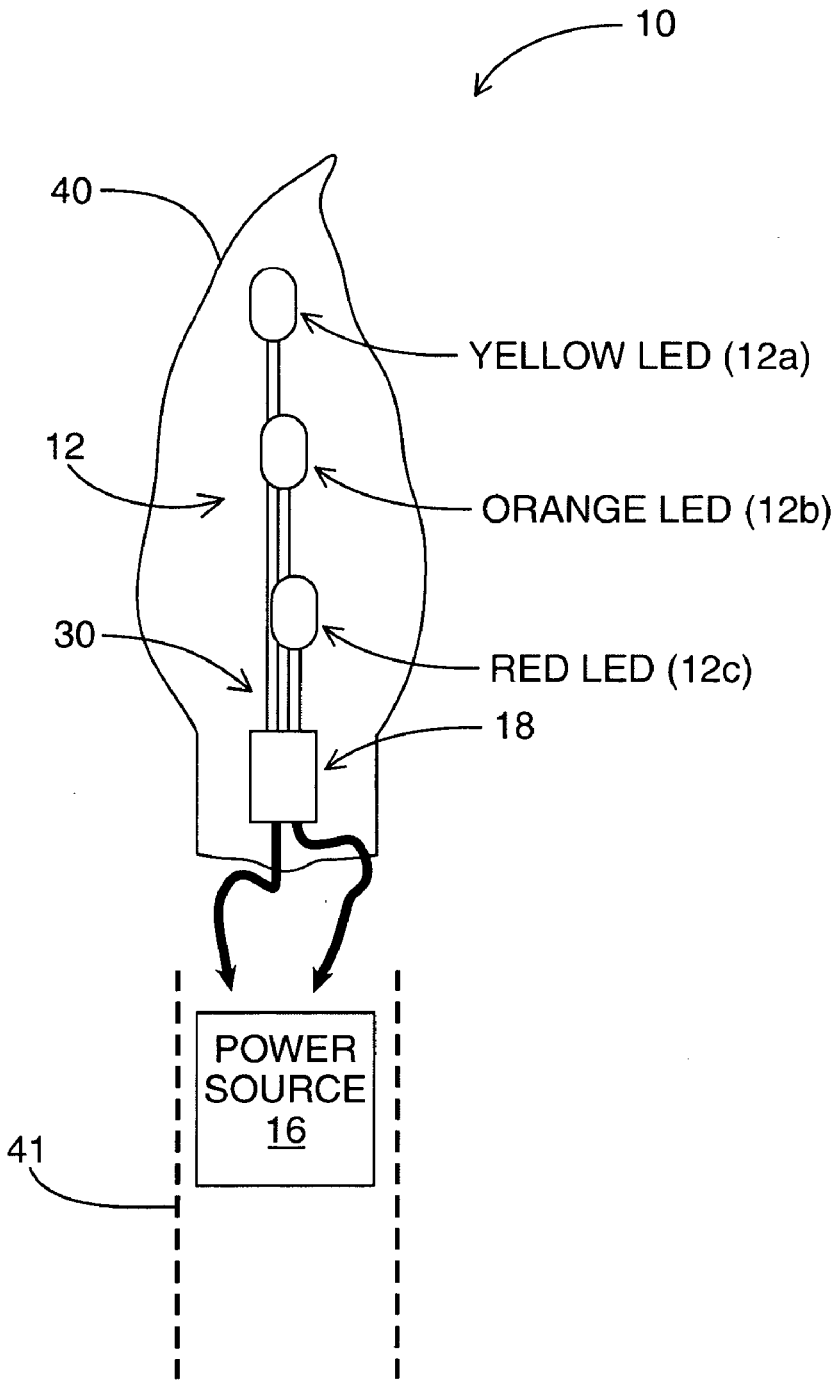
FIG. 1 is a cross-sectional view of the flame simulating device of the present invention.

Referring to FIG. 1, illustrated therein is a flame simulating device 10 made in accordance with a preferred embodiment of the present invention. Flame simulating device 10 consists of an LED lighting assembly 30 that is incased in a substantially translucent shell 40. LED assembly 30 consists of an LED array 12, a power source 16, light source driving circuit 18. Light source driving circuit 18 is designed to allow a maximum of one LED from LED array 12 to be on at any particular time. Also as shown, flame simulating device 10 is also adapted to fit within the top of a base 41. The combination of LED assembly 30 and shell 40 of flame simulating device 10 provides realistic flame lighting effects as will be described.

Shell 40 is substantially translucent in order to allow a substantial amount of light from LED array 12 to penetrate the surface of shell 40 such that visible lighting effects are provided on the surface of shell 40. Shell 40 is preferably flame-shaped (FIG. 1) but it should be understood that shell 40 could be any volumetric container that has enough space within to house LED lighting assembly 30. For example, it is contemplated that shell 40 could have the shape of a pen-shaped tubular body, a spherical ball, a rectangular box, a multisided box, etc. (e.g. adapted to be coupled to a keychain etc.) for application to various novelty items. Other example include yo-yo's, batons, computer mice, lamps, bulbs, night lights, wearable items (e.g. necklaces, broaches, pins, hair accessories, lariats), floral "picks" (longitudinal bodies for use with floral bouquets), picture frames, gear-shift knobs and tire lights to only name a few. Finally, while shell 40 is preferably manufactured from plastic, it should be understood that it could be manufactured from other materials.

As illustrated in FIG. 1, LED array 12 comprises a plurality of LEDs. In order to provide realistic flame effects, it has been determined that it is optimal to use at least one yellow, at least one orange, and at least one red LED within LED array 12. However, it should be understood that it is also possible to use various color types and combination of LEDs within LED array 12 (e.g. the additional use of white LEDs to add brightness to the array, the additional use of blue LEDs to simulate propane gas flame etc.)

For illustrative purposes, the present invention will be described in respect of a LED array 12 that comprises one yellow LED 12*a*, one orange LED 12*b*, and one red LED 12*c* as shown in FIG. 1. Also for discussion purposes, it should be noted that yellow, orange and red LEDs 12*a*, 12*b* and 12*c* are arranged at different heights as measured along the longitudinal axis of flame-shaped shell 40 (FIG. 1). This variation in directional axis (i.e. the longitudinal axis of this example embodiment) further enhances the "flame-like" effect produced by flame simulation device 10 since the different colored LEDs are positioned to represent different parts of a flame.

As conventionally known, LEDs are semiconductor devices that emit a visible light when current biased in the forward direction. Unlike standard bulb type lamps, LEDs are immune to failure conditions such as filament breakage due to sudden shocks or bumps and are well suited for use in articles that may experience sudden impacts from being bounced or shaken such as flame simulating device 10. In addition, LEDs are highly energy efficient as they only require a small amount of electricity to generate a relatively strong light. For example, a typical incandescent lamp operates on 5 volts and uses a current of 115 milliamps while a LED can operate on 3 volts and draw current on the order of 5 to 20 milliamps.

Accordingly, LEDs are a particularly desirable lighting source in applications involving small and lightweight devices where the desired size and weight limits the strength of power sources available thereby making energy efficiency important. The LEDs of LED array 12 are preferably 5 mm high intensity wide dispersion color LEDs. However, it should be understood that many other kinds of LEDs could be utilized depending on the particular visual effect desired or the device production economy required, such as 3 mm on surface mounted lens less LEDs. Since the rated lifetime of these LEDs is approximately 15 years, LED array 12 provides flame simulating device 10 with an energy efficient, long lasting, light weight and durable light source.

Power source 16 is preferably four conventional penlight "AAA" batteries, consisting of two sets in parallel to insure relatively long life. Alternatively, a 6 volt DC adaptor can be used to power a "screw in" bulb version. Power wires 17 are used to connect LED array 12 to power source 16. It has been determined that four penlight "AAA" batteries will run flame simulating device 10 continually for over several months. This long lifetime is due to the fact that light source driving circuit 18 is designed to only allow maximum one LED from LED array 12 to be on at any particular time as will be further discussed. This results in substantial power savings since power source 16 is only required to power at a maximum one LED at any particular time. The power requirements of flame simulating device 10 is substantially less than those of devices that use multiple LEDs where one or more LEDs must be powered at any particular time (i.e. simultaneously).

Figure 2:
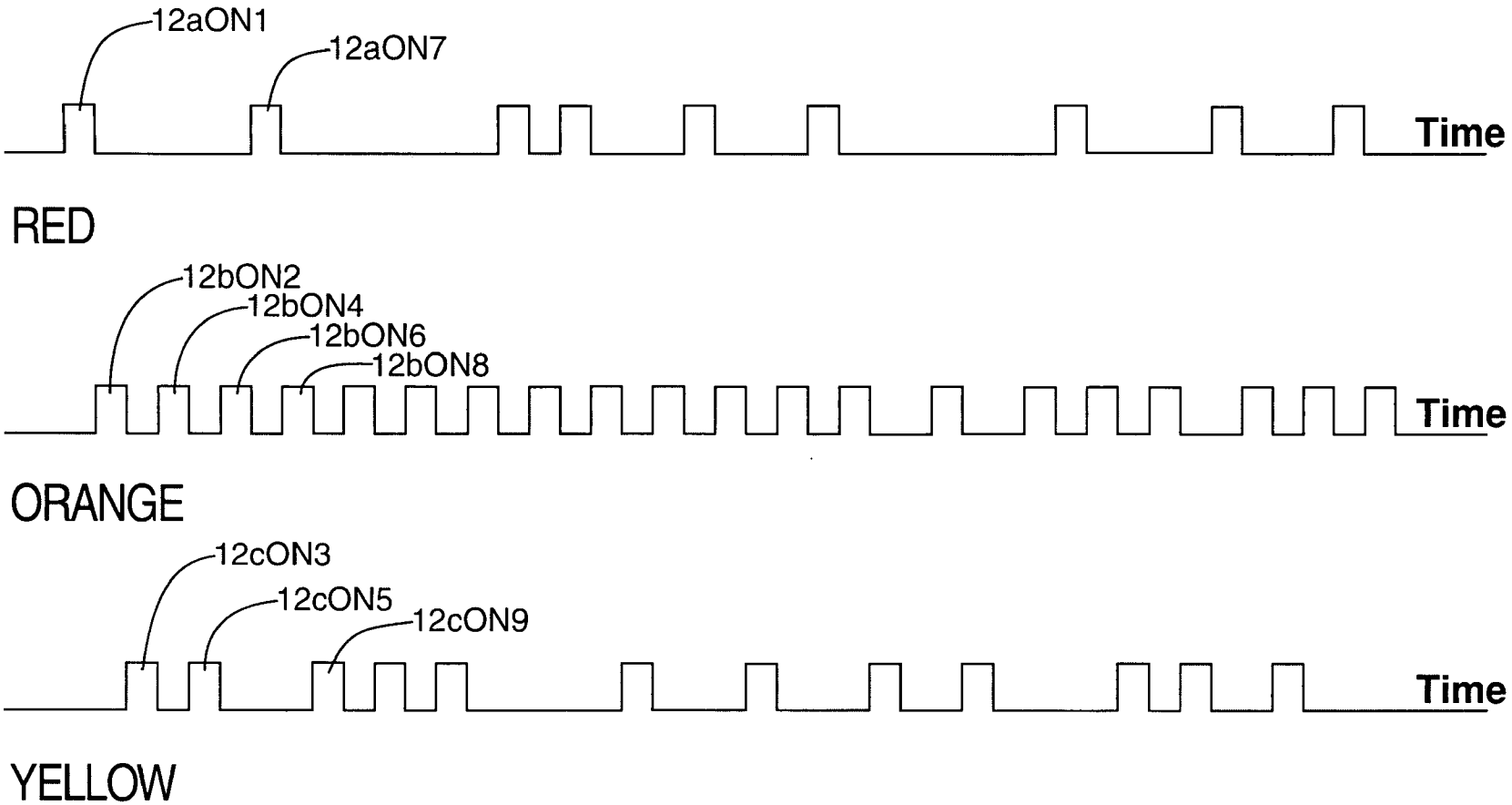
FIG. 2 is a schematic drawing illustrating the duty cycles of the yellow, orange and red light sources of FIG. 1.

Now referring to FIGS. 1 and 2, FIG. 2 illustrates an example activation protocol for the three example LEDs within LED array 12 that have been discussed. It should be understood that many different types of activation profiles and relative positioning of activation characteristics for the various LEDs could be used for the LEDs within LED array 12 of flame simulating device 10. As discussed, generally speaking yellow, orange and red LEDs 12*a*, 12*b* and 12*c* are sequentially activated and deactivated in a manner that simulates the color flickering of a real flame. Specifically, yellow, orange and red LEDs 12*a*, 12*b* and 12*c* are sequentially activated according to a set of color transition rules as will be discussed in more detail below.

The activation characteristics of LEDs within LED array 12 shown in FIG. 2 are represented as follows. For each LED 12*a*, 12*b* and 12*c*, a high level line is used to indicate that an LED is "active" and a low level line is used to indicate that an LED is "inactive". The LEDs within LED array 12 are activated for periods of time such that the human eye perceives the alternate color of each of said yellow, orange and red LED (i.e. long enough activation periods). At the same time, the user sees the color of a particular LED briefly enough so that the "look" of a flame is produced with the requisite flicker and change of color inherent in a real flame.

By doing so, it is possible to achieve a realistic color transition effect on shell 40 as the human eye will perceive the resulting visual display from LED array 12 on shell 40 as being mix of color with moving yellow, orange and red hues. In addition the human eye will perceive that at times, more than one LED is "active" due to the well-known after image that the eye sees even after an LED is already off. Accordingly, unlike the conventional flame bulbs that simply light up or have two wire filaments that are used to cause a twinkling effect, this LED-based flame source will appear to flicker much more like a real flame.

Also, while it is not explicitly shown on the activation characteristics in FIG. 2, each "active" period for a particular LED preferably represents the turning on and off of the LED at a suitable high frequency rate (e.g. 160 times per second per "active" period). It should be understood that it is possible to operate LED assembly 12 during "active" periods without turning on and off (i.e. a steady on for the extent of the "active" period) although power requirements will be higher. The specific high frequency utilized for turning the LED on and off during the "activation" period is selected such that the rapid blinking of an individual LED is not perceptible to the human eye. In practical terms, the LEDs of LED array 12 will be inactive for up to approximately 80% of the time, resulting in substantial power savings and long life for a fixed battery power source 16. As discussed previously, a typical LED can operate on 3 volts and draw current on the order of 5 to 20 milliamps. However, since the LEDs within LED array 12 are inactive up to 80% of the time, the current draw of LED array 12 is greatly reduced and has been determined to be as low as 5 mA per LED In this particular example, light source driving circuit 18 sequentially activates LEDs 12*a*, 12*b* and 12*c*. As shown, the following activation cycle is executed: red (12*a*ON1), orange (12*b*ON2), yellow (12*c*ON3), orange (12*b*ON4), yellow (12*c*ON5), orange (12*b*ON6), red (12*a*ON7), orange (12*b*ON8), yellow (12*c*ON9) etc. It has been determined that it is beneficial to cycle between yellow and orange, between orange and red, but not between red and yellow, in order to minimize the "color" transition difference. Further, since LED array 12 is encased in a translucent shell 40, the LED colors will mix and blend providing an impression that the shell 40 "glows" much like a true flame glows.

It has been determined that when using LEDs that emit light at different frequencies (i.e. the frequencies associated with yellow, orange, red etc.), it is preferable to sequentially activate LEDs that emit light at frequencies which are close together in order to minimize the length of the color "steps" (i.e. to minimize the visible difference in color between activated LEDs). Accordingly, the LED lighting sequence steps in the example (i.e. as shown in FIG. 2) follow such transition rules. For example, in the case of the yellow, orange and red LEDs shown in FIG. 2, yellow is never activated before or after red. Rather, since orange is closer in emitted color to yellow and red, activation transitions move between red and orange and between orange and yellow. However, it should be understood, that many other specific lighting sequences could be used.

Figure 3:
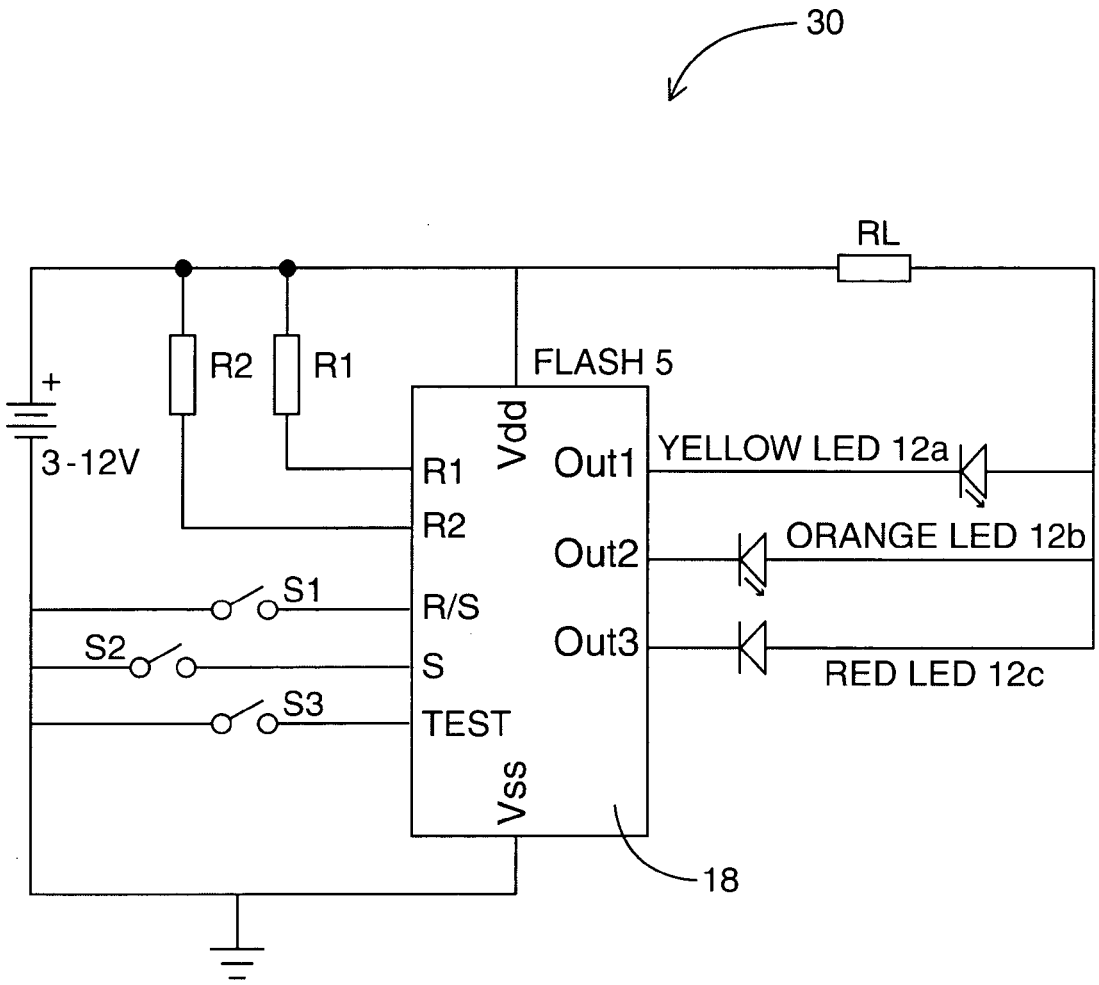
FIG. 3 is a schematic drawing of an example implementation of LED lighting assembly that drives the LED array of FIG. 1.

FIG. 3 shows an example implementation of LED lighting assembly 30. The main component is a light source driving circuit 18 that contains the logic circuitry that controls the output of LED array 12. Light source driving circuit 18 is most likely a designed chip on board (COB) that can be customized for this application. Light source driving circuit 18 could be adapted to be integrated with the LEDs of LED array 12 to form a single sub-assembly complete with embedded program. The outputs of light source driving circuit 18 are each connected to a separate LED in LED array 12. LED array 12 itself is connected in series with a load resistor RL that limits the current passing through the LEDs of LED array 12.

The preprogrammed sequence controls the output state of the flame simulating device 10. As discussed above, it is preferred to leave the input unconnected in order to cause the LEDs of LED array 12 to light up in a sequential order. It should be understood that although this exemplary embodiment contains the aforementioned inputs this embodiment is only one example implementation. Other embodiments may contain fewer or greater inputs depending on the specific implementation. Light source driving circuit 18, its functionality and components are described in greater detail below.

Figure 4:
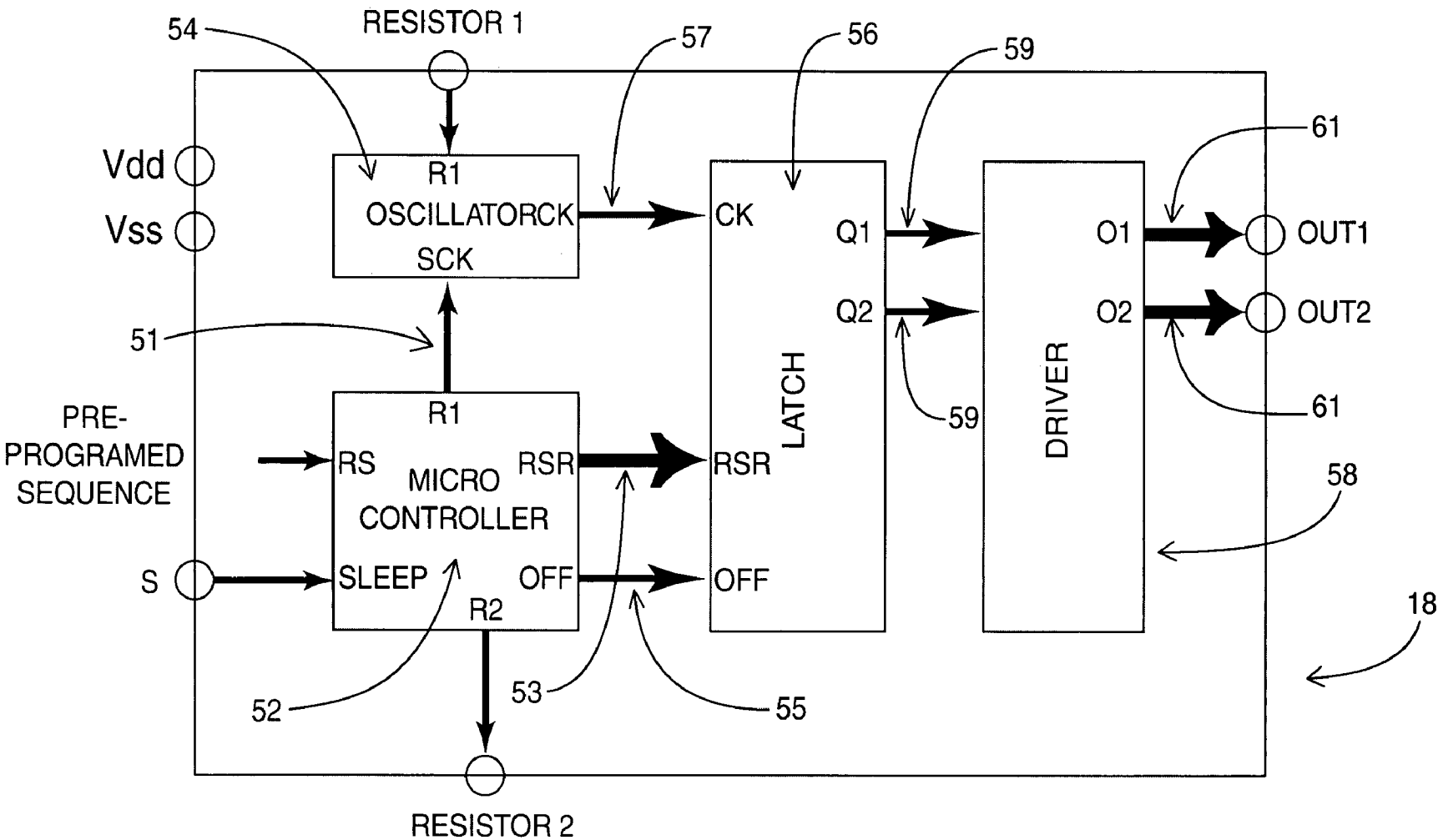
FIG. 4 is a block diagram of an example implementation of control circuit of FIG. 3.

Now referring to FIGS. 2, 3 and 4, FIG. 4 illustrates a light source driving circuit 18 in block diagram form. Specifically, light source driving circuit 18 includes a microcontroller 52, an oscillator 54, a latch 56 and a driver 58. Microcontroller 52 is electrically coupled to oscillator 54, through the SCK line 51, and to latch 56, through the RSR line 53 and OFF line 55. Oscillator 54 is also coupled to the latch 56 through the CK line 57. In turn, the latch 56, through information lines 59, is coupled to the driver 58 which itself is electrically coupled to the LEDs in LED array 12 through output lines 61.

Microcontroller 52 determines the output state of the flame simulating device 10, which could be programmable or off. This unit has three inputs, preprogrammed sequence, S (sleep) and R2 (resistor 2) and three outputs, SK (stop clock), RSR (random or sequential) and OFF. Connecting the S input to Vss causes microcontroller 52 to enable the clock signal and latch 56 by sending the appropriate digital signals over the SCK 51 and OFF 55 lines respectively. The result is that the flame simulating device 10 is activated thereby causing LED array 12 to emit light.

Flame simulating device 10 continues to function until the unit is turned off, at which point, microcontroller 52 disables the clock signal by sending the appropriate digital signal through the SCK line 51 to oscillator 54. At this time, microcontroller 52 also disables latch 56 by sending the appropriate digital signal through the OFF line 55. This causes the output to be disabled and the flame simulating device 10 to shut down. Since the preprogrammed sequence line is unconnected, the LEDs of LED array 12 light up sequentially according to a particular transitional rule (i.e. following a strict color order) as will be further described. Microcontroller 52 sends the appropriate digital signal, through the RSR line 53 to the latch 56, which in turn generates the appropriate output.

Oscillator 54 generates the periodic clock signal that is used to control timing within the circuit. The oscillator has two inputs, SCK (stop clock) and R1 (resistor 1), and one output, CK (the clock signal). The clock signal is transmitted to latch 56 along the CK line 57. The resistor connected to R1 together with an internal capacitance determines a time constant for the circuit, which in turn determines the period of the clock signal. During normal operation, an appropriate digital signal is received from microcontroller 52 along the SCK line 51 and the clock signal is enabled. When flame simulating device 10 is shut off, microcontroller 52 sends an alternative signal via the SCK line 51 and the CK (clock) signal is disabled.

While the clock rate of the LED controller can be set at 160 Hz, the actual flash rate of the individual LEDs (i.e. yellow LED 12*a*, orange LED 12*b*, and red LED 12*c*) can be varied throughout the length of the programmed routine, resulting in a more "flame like" appearance. Individual LED frequencies are set visually and then programmed directly into processor. As discussed before, a maximum of one LED is activated at any given time and even when a LED is activated it is being blinked on and off at a rapid frequency.

Even so, a user will not perceive that there are any times when all LEDs are inactive (when in fact up to 80% of the time there will be no activated LEDs). As discussed above, since a maximum of one LED is activated at any given time (i.e. there are times at which all LEDs are inactive for short bursts of time), it is possible to run flame simulating device 10 on a set (i.e. finite such as a battery) power supply 16 for a relatively long time. Specifically, it is possible to run flame simulating device 10 for longer than a device which requires at least one LED to be powered at a given time.

Latch 56 contains the logic circuitry used to generate the appropriate output sequences. Latch 56 has three inputs, CK, RSR and OFF, and a number of outputs equal to the number of LEDs in LED array 12. Each output corresponds to a separate LED in LED array 12. Based on the preprogrammed sequence, latch 56 activates each of the appropriate output signals sequentially. It should be noted that latch 56 can also be programmed to sequence the output in different orders other than sequentially, although it is preferred in this invention to have sequential activation of LEDs in color order.

Driver 58 is essentially a buffer between latch 56 and the LED array 12. Driver 58 ensures that sufficient power is supplied to the LEDs in LED array 12 and that the current drawn from the outputs of latch 56 is not too great. During normal operation, the output of the driver 58 tracks the output of latch 56.

It should be understood that the above circuit descriptions in FIG. 3 and FIG. 4 are only meant to provide an illustration of how LED assembly 30 may be implemented and configured and that many other implementations are possible. LED assembly 30 is not circuit dependent and therefore neither is flame simulating device 10. There are many possible circuit configurations that may be used in alternative embodiments to achieve a result substantially similar to that described above.

Figure 5:
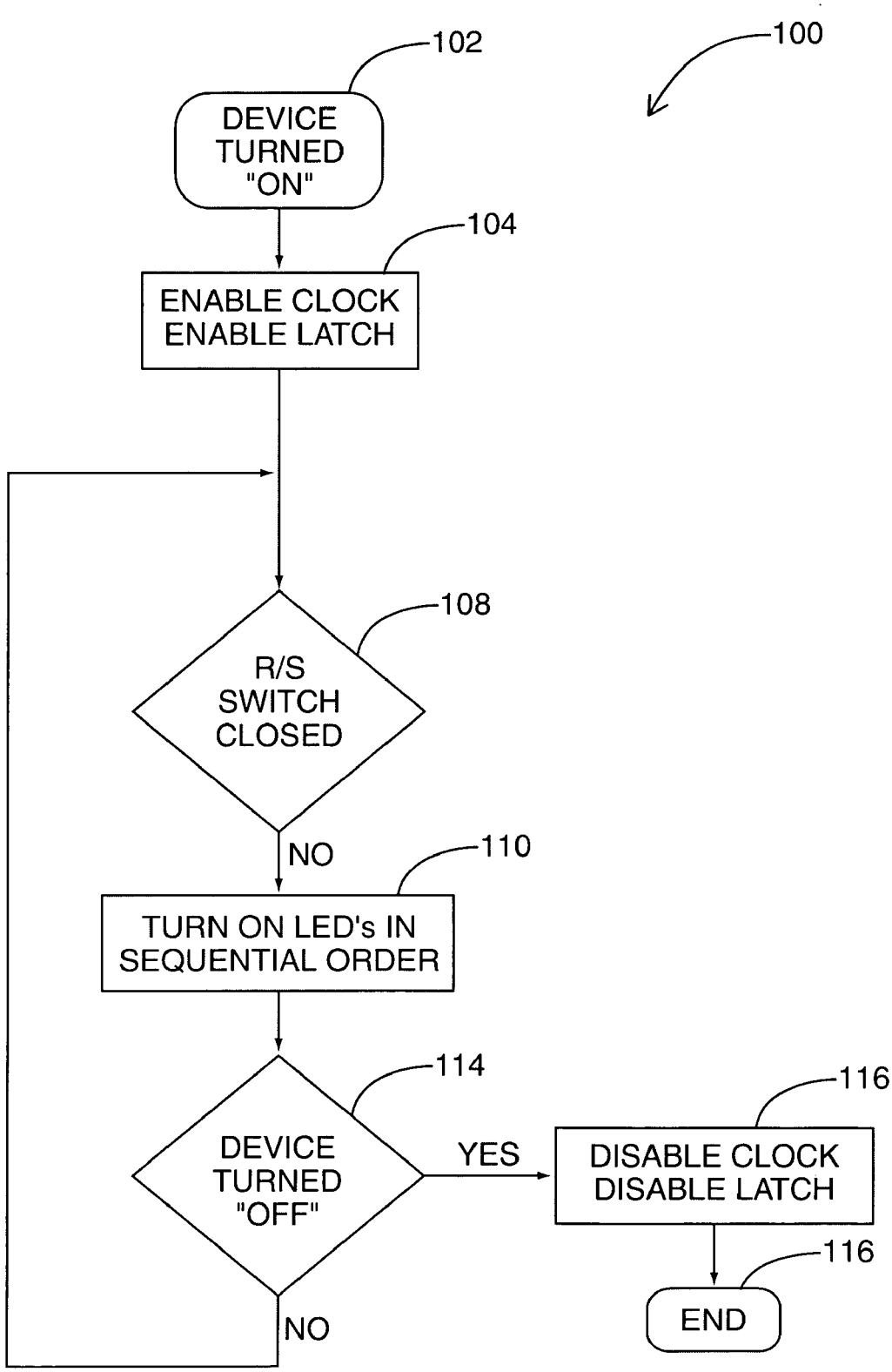
FIG. 5 is a flow-chart illustrating the main steps of the MAIN OPERATION routine utilized by the microcontroller to control the output of the LED array of FIG. 4.

Reference is now made to FIG. 5, illustrated therein is the MAIN OPERATION routine 100 utilized by microcontroller 52 to control the output of LED array 12. The routine commences at step (102) when the flame simulation device 10 is turned "on", that is, S switch 20 is manually closed. It is also possible for switch to be closed using various types of activation devices (e.g. a an audio deactivation device as will be described in relation to FIG. 6). At step (104) microcontroller 20 enables the clock signal and latch 24 by sending an appropriate signal through the SCK 51 and OFF 55 lines respectively.

At step (108) microcontroller 52 determines the preprogrammed sequence input and sends the appropriate digital signal to latch 56 through the RSR line 53. In turn latch 56 generates the appropriate output at step (110). That is, at step (110) the LEDs in LED array 12 are turned on in sequential order. Specifically, yellow, orange and red LEDs 12*a*, 12*b* and 12*c* are sequentially activated in a "single LED" and "up/down" sequence according to the color transition rules discussed above.

As noted, it has been determined that it is beneficial to cycle between yellow and orange, between orange and red, but not between red and yellow, in order to minimize the "color" transition difference. Accordingly, microcontroller 52 is programmed to follow these color transition rules when executing LED lighting sequence steps and activating specific LEDs. Application of these color transition rules is illustrated in the duty cycle graphs of FIG. 2 which indicate the following LED activation sequence: red (12*a*), orange (12*b*), yellow (12*c*), orange (12*b*), yellow (12*c*), orange (12*b*), red (12*a*), orange (12*b*), yellow (12*c*).

Then at step (114) microcontroller 52 determines whether or not flame simulation device 10 has been turned "off". If not, then the routine cycles back to step (108) and repeats itself. If so, then at step (116), microcontroller 52 disables the clock and latch 56 by sending the appropriate signals over the SCK 51 and OFF 55 lines respectively. Flame simulating device 10 is then inactive until the switch closes again at step (102).

Figure 6:
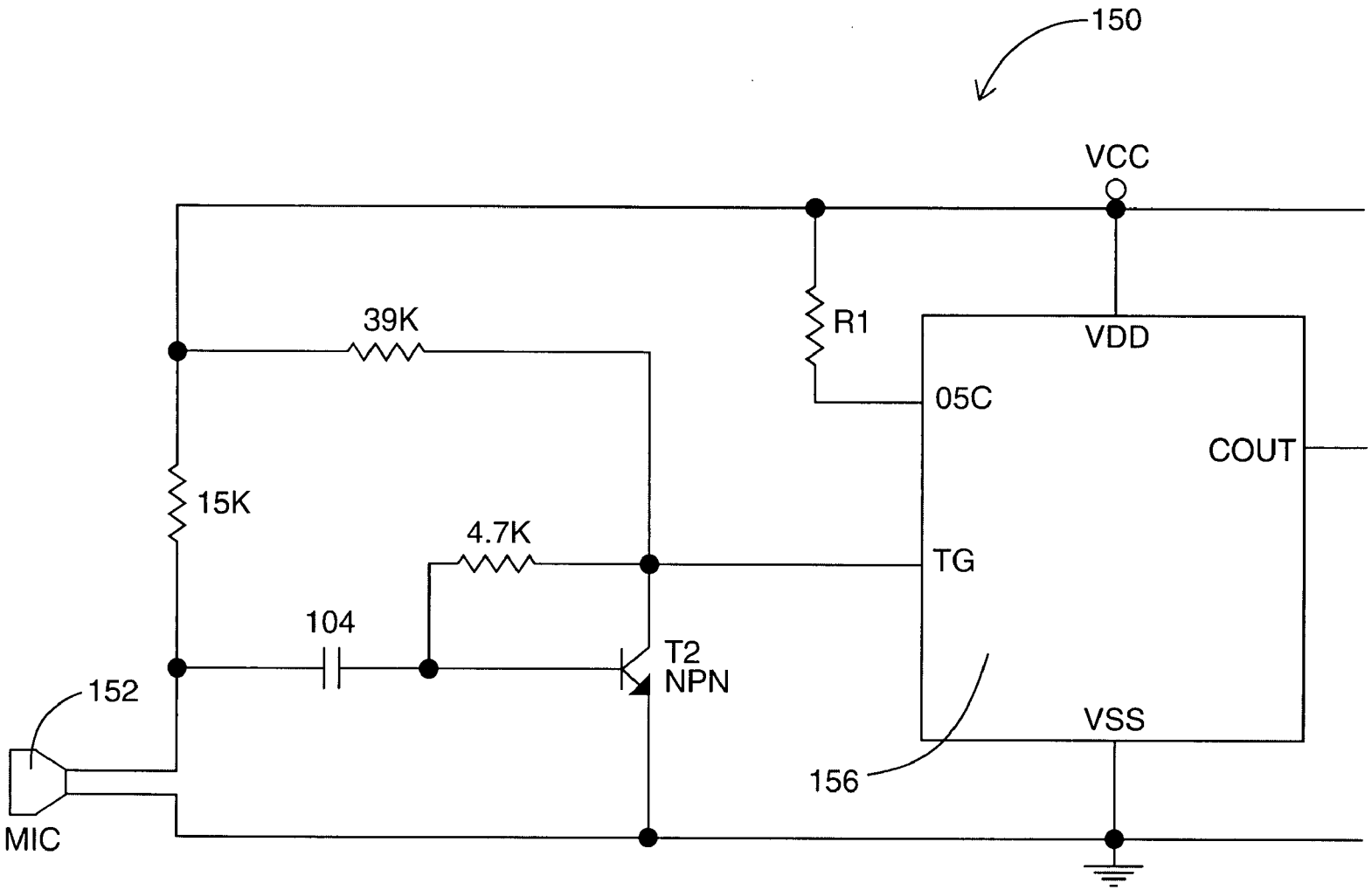
FIG. 6 is a schematic drawing of an example implementation of an audio deactivator device that shuts off the light source driving circuit of FIG. 1.

FIG. 6 illustrates an optional audio deactivation device 150 that can be used to deactivate light source driving circuit 18. Audio deactivation device 150 allows the user to in effect "blow out" the flame (as a user typically "blows out" a candle) by blowing air close to the LED array 12 as will be described. Specifically, audio deactivation device 150 includes a microphone 152 and another latch 156. It should be understood that any other sound sensitive device (e.g. a piezo crystal buzzer, etc.) could be utilized instead of microphone 152. Preferably, microphone 152 is positioned in close proximity to LED array 12 for most intuitive effect.

When a user blows at LED array 12, microphone 152 senses the sound increase and a large delta spike in circuit resistance results within circuit resistors (shown as 15 Kohm, 29 Kohm, 4.7 Kohm), capacitor (shown as 104 microfarads) and transistor T2. In turn, the trigger input TG of latch 156 is enabled and causes latch 156 to disrupt the voltage being provided at VDD to output Cout which is connected to the power input (not shown) of light source driving circuit 18.

In addition, it is contemplated that a photosensor-based turn-off circuit (not shown) could also be utilized to deactivate light source driving circuit 18 and audio deactivation device 150 when a photosensor (not shown) is exposed to light. When the power is removed from light source driving circuit 18 and audio deactivation device 150, the latches associated with these circuits are reset. Once the light dims, the photosensors will emit an operational signal (i.e. time to turn flame simulating device 10 back on) and the associated latches will then be enabled again to power LED array 12. The use of such a photosensor-based turn-off circuit results in additional power savings since the unit would be turned off during daylight hours and does not require manual deactivation and activation (i.e. in a restaurant or other hospitality setting).

Various alternatives to the preferred embodiment of the flame simulating device 10 are possible. For example, the LED array 12 of flame simulating device 10 can be fabricated out of different types of LEDs that may, for example, have different colors, intensities and dispersion angles. Furthermore, it is also possible to implement the LED array 12 with fewer or larger numbers of LEDs. Also, light source driving circuit 18 could be adapted to activate at least one LED at a time although there would be a commensurate rise in the required power from power supply 16 and a reduction in the lifetime of a set (i.e. finite such as a battery) power supply 16. In addition, the shape, size and material of the shell 40 may be varied. Furthermore, power source 16 can be comprised of any appropriate type of battery. While it is preferred for power source 16 to have an output voltage in the range of 3 to 12 V DC, it is possible to manufacture the decorative display assembly to operate outside this range. In addition, many other circuit configurations may be used to implement the same or similar functionality.

As will be apparent to persons skilled in the art, various modifications and adaptations of the structure described above are possible without departure from the present invention, the scope of which is defined in the appended claims.

The invention claimed is:

1. A flame simulating device comprising:

(a) a substantially translucent shell having a hollow interior and a directional axis;

(b) a plurality of colored light sources, adapted to be positioned within the hollow interior of said shell, wherein said light sources include a first light source emitting light having a first frequency, a second light source emitting light having a second frequency and a third light source emitting light having a third frequency and wherein said third frequency is greater than said second frequency and said second frequency is greater than said first frequency;

(c) a light source driving device for selectively activating said first, second and third light sources according to the following transition rules:

i. if the first light source is active then activate the second light source next;

ii. if the second light source is active then activate either the first light source or the third light source next; and iii. if the third light source is active then activate the second light source next;

(d) each of said first, second and third light sources being sequentially activated such that the surface of said shell is illuminated and produces an animated flame effect.

2. The device of claim 1, wherein said plurality of light sources include light sources selected from the group consisting of: yellow, orange and red light sources.

3. The device of claim 1, wherein each of said light sources are activated on a mutually exclusive basis to minimize power requirements for the device.

4. The device of claim 1, wherein when one of said plurality of light sources is activated, said light source driving device turns the light source on and off at a selected frequency such that the of periods are not perceivable by a human eye to minimize power requirements for the device.

5. The device of claim 1, wherein said first light source is located below said second light source as measured along the directional axis of said shell and said second light source is located below said third light source as measured along the directional axis of said shell.

6. The device of claim 1, wherein the duty cycle of said second light source is greater than the duty cycle of said third light source and greater than the duty cycle of said first light source.

7. The device of claim 1, wherein said plurality of light sources are positioned in a spaced apart manner at different heights as measured along the directional axis of said shell.

8. The device of claim 7, wherein said plurality of light sources are activated in consecutive order up and down the directional axis of said shell.

9. The device of claim 1, wherein the shape of the shell is selected from the group consisting of: flame-shaped, spherical, tubular, rectangular box.

10. The device of claim 1, further comprising an audio sensor, wherein light source driving device is deactivated when the audio sensor detects sound.

11. The device of claim 10, wherein the audio sensor is positioned in close proximity to the plurality of light sources.

12. The device of claim 1, further comprising a light sensor wherein said light source driving device is deactivated when the light sensor detects light and activated when the light sensor no longer detects light.

* * * * *

UNITED STATES PATENT AND TRADEMARK OFFICE

CERTIFICATE OF CORRECTION

PATENT NO. : 7,125,142 B2
APPLICATION NO. : 10/838785
DATED : October 24, 2006
INVENTOR(S) : Harry Lee Wainwright It is certified that error appears in the above-identified patent and that said Letters Patent is hereby corrected as shown below:

Claim 1, column 9, line 27, replace "second and third light sources" with --second and third sources--

Claim 4, column 10, line 7, replace "such that the of periods" with --such that the off periods--

Signed and Sealed this

Third Day of April, 2007

JON W. DUDAS
*Director of the United States Patent and Trademark Office*